US009538308B2

(12) United States Patent
Isaac

(10) Patent No.: US 9,538,308 B2
(45) Date of Patent: Jan. 3, 2017

(54) ADAPTIVE ROOM EQUALIZATION USING A SPEAKER AND A HANDHELD LISTENING DEVICE

(71) Applicant: Apple Inc., Cupertino, CA (US)

(72) Inventor: Ronald N. Isaac, San Ramon, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/775,585

(22) PCT Filed: Mar. 13, 2014

(86) PCT No.: PCT/US2014/026539
§ 371 (c)(1),
(2) Date: Sep. 11, 2015

(87) PCT Pub. No.: WO2014/160419
PCT Pub. Date: Oct. 2, 2014

(65) Prior Publication Data

US 2016/0029142 A1 Jan. 28, 2016

Related U.S. Application Data

(60) Provisional application No. 61/784,812, filed on Mar. 14, 2013.

(51) Int. Cl.
*H04R 5/02* (2006.01)
*H04S 7/00* (2006.01)

(52) U.S. Cl.
CPC ..... *H04S 7/301* (2013.01); *H04S 7/307* (2013.01); *H04S 2400/01* (2013.01); *H04S 2400/15* (2013.01); *H04S 2420/07* (2013.01)

(58) Field of Classification Search
USPC ..... 381/58, 59, 89, 96, 111, 303, 320, 94.2, 381/358, 386, 103
See application file for complete search history.

(56) References Cited

U.S. PATENT DOCUMENTS 8,094,826 B2 * 1/2012 Pedersen ..... H04S 3/00 381/103
2006/0062398 A1 * 3/2006 McKee Cooper ..... G01S 11/14 381/58

(Continued)

FOREIGN PATENT DOCUMENTS

CN 1076072 9/1993
CN 101009953 8/2007

(Continued)

OTHER PUBLICATIONS

PCT International Preliminary Report on Patentability for PCT International Appln No. PCT/US2014/026539 mailed on Sep. 24, 2015 (8 pages).

(Continued)

*Primary Examiner* — Yosef K Laekemariam
(74) *Attorney, Agent, or Firm* — Blakely, Sokoloff, Taylor & Zafman LLP

(57) ABSTRACT

A loudspeaker that measures the impulse response of a listening area is described. The loudspeaker may output sounds corresponding to a segment of an audio signal. The sounds are sensed by a listening device proximate to a listener and transmitted to the loudspeaker. The loudspeaker includes an adaptive filter that estimates the impulse response of the listening area based on the signal segment. An error unit analyzes the estimated impulse response together with the sensed audio signal received from the listening device to determine the accuracy of the estimate. New estimates may be generated by the adaptive filter until an accuracy level is achieved for the signal segment. A processor may utilize one or more estimated impulse responses corresponding to various signal segments that cover a defined frequency spectrum for adjusting the audio (Continued)

signal to compensate for the impulse response of the listening area. Other embodiments are also described.

23 Claims, 7 Drawing Sheets

(56) References Cited

U.S. PATENT DOCUMENTS

| | | | |
|---|---|---|---|
| 2007/0127730 | A1 | 6/2007 | Kim et al. |
| 2011/0268281 | A1 | 11/2011 | Florencio et al. |
| 2012/0213375 | A1 | 8/2012 | Mahabub et al. |
| 2012/0288124 | A1 | 11/2012 | Fejzo et al. |

FOREIGN PATENT DOCUMENTS

| | | |
|---|---|---|
| JP | 2005-057545 | 3/2005 |
| JP | 2005057545 | 3/2005 |
| WO | WO 2007/076863 A1 | 7/2007 |
| WO | WO-2007076863 | 7/2007 |

OTHER PUBLICATIONS

PCT International Search Report and Written Opinion for PCT International Appln No. PCT/US2014/026539 filed on Mar. 13, 2014 (10 pages).

AU Patent Examination Report No. 1 (Dated Jan. 6, 2016) AU Patent Application No. 2014243797, filed Mar. 13, 2014, (Jan. 6, 2016), 2.

Summit Wireless, "MyZone Automatic Sweetspot Detection", URL: http://summitwireless.com/technology/myzone/; Download date: Feb. 28, 2013, 1 Page.

Usher, John , "Acoustic impulse response measurement using speech and music signals", Audio Engineering Societ Convention Paper 8026, presented at the 128th Convention, London, UK, (May 22-25, 2010), 11 Pages.

Chinese Office Action with English Language Translation, dated Aug. 1, 2016, Chinese Application No. 201480022813.9.

English Translation of Korea Office Action for Korean Patent Application No. 10-2015-7028118, dated Aug. 23, 2016, 4 pages.

Korean Office Action with English Language Translation, dated Aug. 23, 2016, Korean Application No. 10-2015-7028118.

* cited by examiner

ADAPTIVE ROOM EQUALIZATION USING A SPEAKER AND A HANDHELD LISTENING DEVICE

RELATED MATTERS

This application is a U.S. National Phase Application under 35 U.S.C. §371 of International Application No. PCT/US2014/026539, filed Mar. 13, 2014, which claims the benefit of the earlier filing date of U.S. provisional application No. 61/784,812, filed Mar. 14, 2013.

FIELD

A loudspeaker for measuring the impulse response of a listening area using a handheld sensing device during normal operation of the loudspeaker is described. Other embodiments are also described.

BACKGROUND

Loudspeakers and loudspeaker systems (hereinafter "loudspeakers") allow for the reproduction of sound in a listening environment or area. For example, a set of loudspeakers may be placed in a listening area and driven by an audio source to emit sound at a listener situated at a location within the listening area. The construction of the listening area and the organization of objects (e.g., people and furniture) within the listening area create complex absorption/reflective properties for sound waves. As a result of these absorption/reflective properties, "sweet spots" are created within the listening area that provide an enhanced listening experience while leaving a poor listening experience for other areas of the listening area.

Audio systems have been developed that measure the impulse response of the listening area and adjust audio signals based on this determined impulse response to improve the experience of a listener at a particular location in the listening area. However, these systems rely on known test signals that must be played in a prescribed fashion. Accordingly, the determined impulse response of the listening area is difficult to obtain.

SUMMARY

One embodiment of the invention is directed to a loudspeaker that measures the impulse response of a listening area. The loudspeaker may output sounds corresponding to a segment of an audio signal. The sounds are sensed by a handheld listening device proximate to a listener and transmitted to the loudspeaker. The loudspeaker includes a least mean square filter that generates a set of coefficients representing an estimate of the impulse response of the listening area based on the signal segment. An error unit analyzes the set of coefficients together with a sensed audio signal received from the handheld listening device to determine the accuracy of estimated impulse response of the listening area. New coefficients may be generated by the least mean square filter until a desired accuracy level for the impulse response is achieved (i.e., an error signal/value below a predefined level).

In one embodiment, sets of coefficients are continually computed for multiple input signal segments of the audio signal. The sets of coefficients may be analyzed to determine their spectrum coverage. Sets of coefficients that sufficiently cover a desired set of frequency bands may be combined to generate an estimate of the impulse response of the listening area relative to the location of the listener. This impulse response may be utilized to modify subsequent signal segments of the audio signal to compensate for effects/distortions caused by the listening area.

The system and method described above determines the impulse response of the listening area in a robust manner while the loudspeaker is performing normal operations (e.g., outputting sound corresponding to a musical composition or an audio track of a movie). Accordingly, the impulse response of the listening area may be continually determined, updated, and compensated for without the use of complex measurement techniques that rely on known audio signals and static environments.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1A:
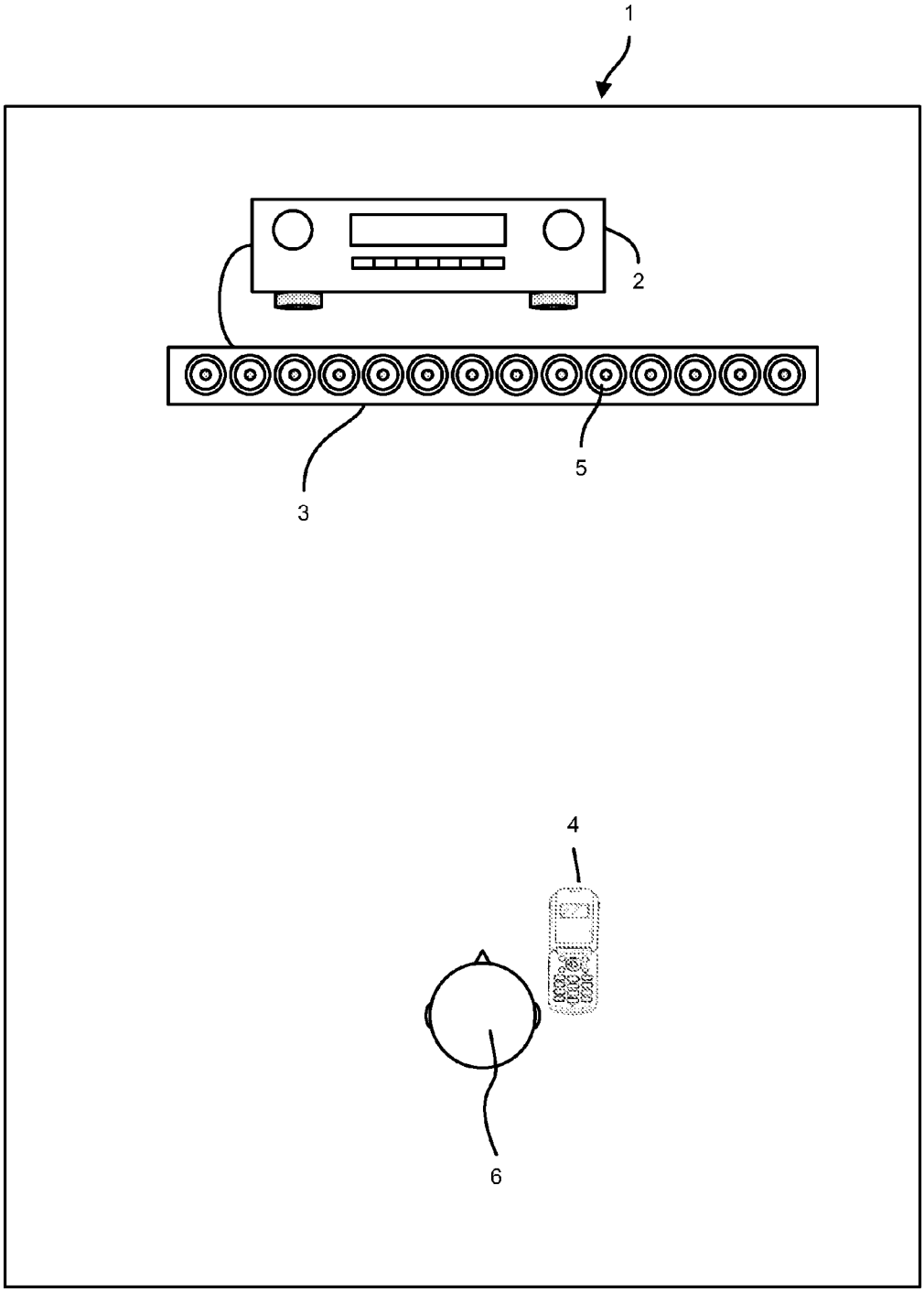
FIG. 1A shows a view of a listening area with an audio receiver, a loudspeaker, and a handheld listening device.

FIG. 1A shows a view of a listening area 1 with an audio receiver 2, a loudspeaker 3, and a handheld listening device 4. The audio receiver 2 may be coupled to the loudspeaker 3 to drive individual transducers 5 in the loudspeaker 3 to emit various sounds and sound patterns into the listening area 1. The handheld listening device 4 may be held by a listener 6 and may sense these sounds produced by the audio receiver 2 and the loudspeaker 3 using one or more microphones as will be described in further detail below.

Figure 1B:
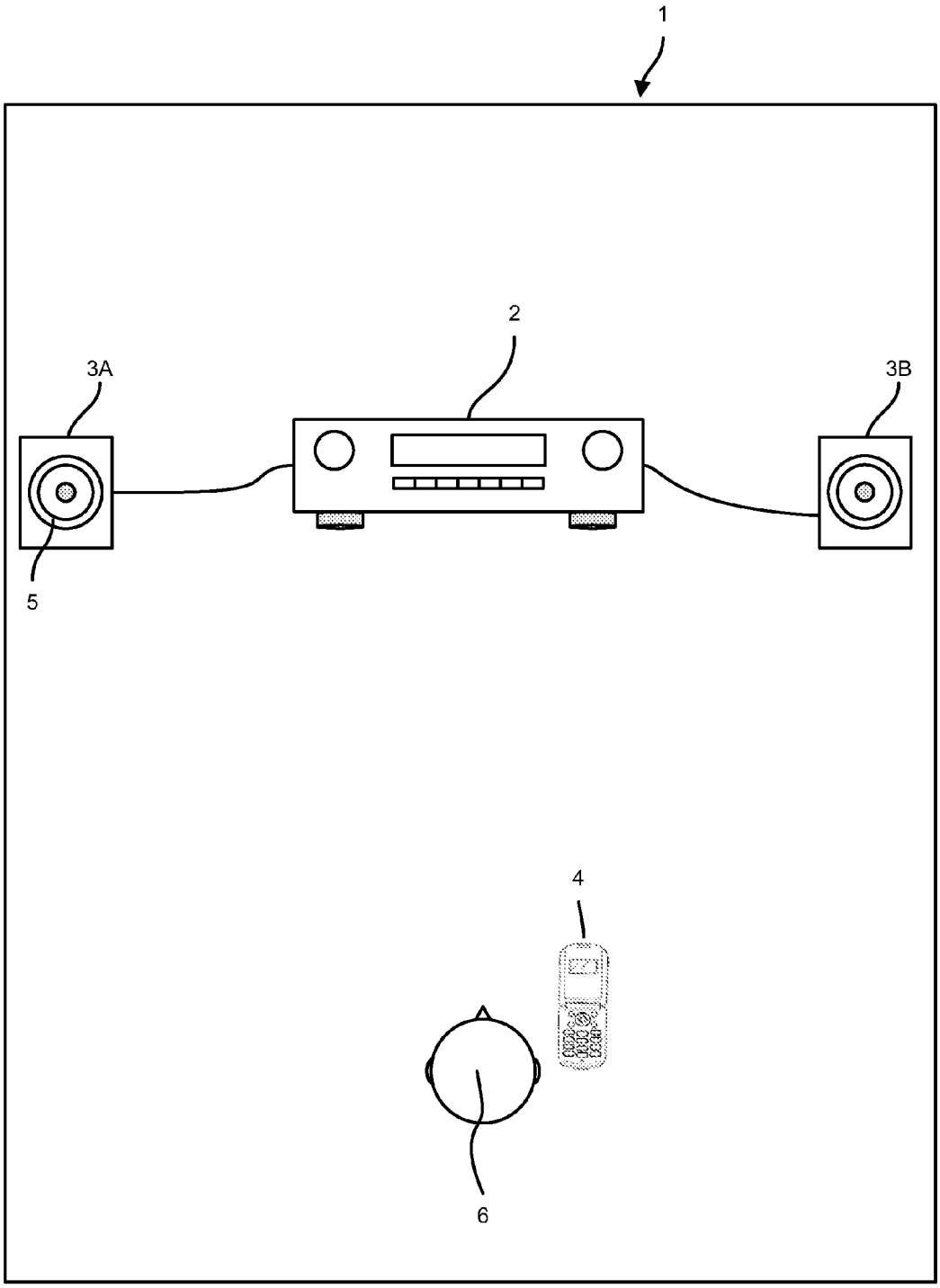
FIG. 1B shows a view of another listening area with an audio receiver, multiple loudspeakers, and a handheld listening device.

Although shown in FIG. 1A with a single loudspeaker 3, in another embodiment multiple loudspeakers 3 may be coupled to the audio receiver 2. For example, as shown in FIG. 1B, the loudspeakers 3A and 3B are coupled to the audio receiver 2. The loudspeakers 3A and 3B may be positioned in the listening area 1 to respectively represent front left and front right channels of a piece of sound program content (e.g., a musical composition or an audio track for a movie).

Figure 2:
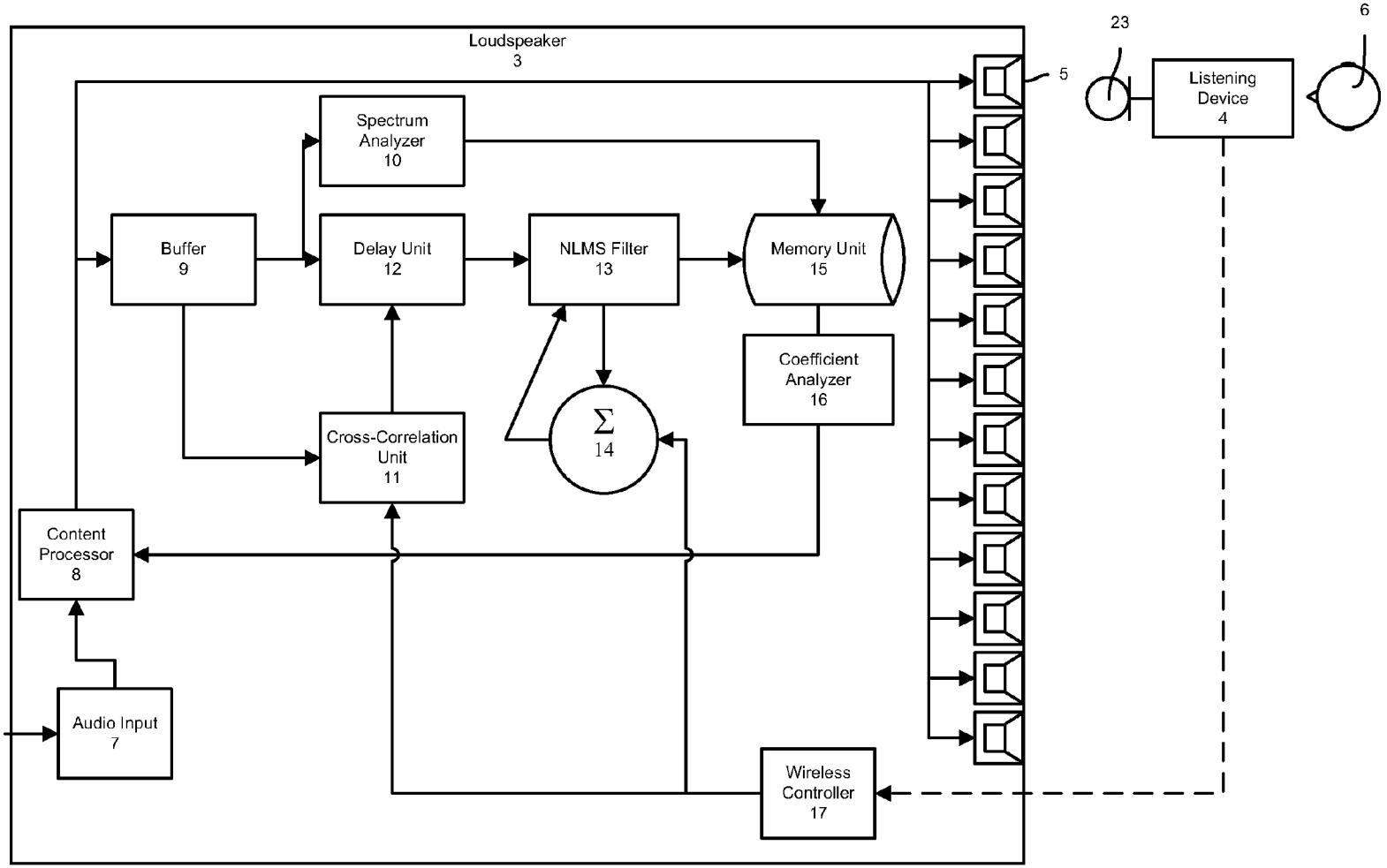
FIG. 2 shows a functional unit block diagram and some constituent hardware components of a loudspeaker according to one embodiment.

FIG. 2 shows a functional unit block diagram and some constituent hardware components of the loudspeaker 3 according to one embodiment. The components shown in FIG. 2 are representative of elements included in the loudspeaker 3 and should not be construed as precluding other components. The elements shown in FIG. 2 may be housed in a cabinet or other structure. Although shown as separate, in one embodiment the audio receiver 2 is integrated within the loudspeaker 3. Each element of the loudspeaker 3 will be described by way of example below.

The loudspeaker 3 may include an audio input 7 for receiving audio signals from an external device (e.g., the audio receiver 2). The audio signals may represent one or more channels of a piece of sound program content (e.g., a musical composition or an audio track for a movie). For example, a single signal corresponding to a single channel of a piece of multichannel sound program content may be received by the input 7. In another example, a single signal may correspond to multiple channels of a piece of sound program content, which are multiplexed onto the single signal.

In one embodiment, the audio input 7 is a digital input that receives digital audio signals from an external device. For example, the audio input 7 may be a TOSLINK connector or a digital wireless interface (e.g., a WLAN or Bluetooth receiver). In another embodiment, the audio input 7 may be an analog input that receives analog audio signals from an external device. For example, the audio input 7 may be a binding post, a Fahnestock clip, or a phono plug that is designed to receive a wire or conduit.

In one embodiment, the loudspeaker 3 may include a content processor 8 for processing an audio signal received by the audio input 7. The processing may operate in both the time and frequency domains using transforms such as the Fast Fourier Transform (FFT). The content processor 8 may be a special purpose processor such as an application-specific integrated circuit (ASIC), a general purpose microprocessor, a field-programmable gate array (FPGA), a digital signal controller, or a set of hardware logic structures (e.g. filters, arithmetic logic units, and dedicated state machines).

The content processor 8 may perform various audio processing routines on audio signals to adjust and enhance sound produced by the transducers 5 as will be described in more detail below. The audio processing may include directivity adjustment, noise reduction, equalization, and filtering. In one embodiment, the content processor 8 modifies a segment (e.g., time or frequency division) of an audio signal received by the audio input 7 based on the impulse response of the listening area 1 determined by the loudspeaker 3. For example, the content processor 8 may apply the inverse of the impulse response received from the loudspeaker 3 to compensate for distortions caused by the listening area 1. A process for determining the impulse response of the listening area 1 by the loudspeaker 3 will be described in further detail below.

The loudspeaker 3 includes one or more transducers 5 arranged in rows, columns, and/or any other configuration within a cabinet. The transducers 5 are driven using audio signals received from the content processor 8. The transducers 5 may be any combination of full-range drivers, mid-range drivers, subwoofers, woofers, and tweeters. Each of the transducers 5 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 5 magnetic system interact, generating a mechanical force that causes the coil (and thus, the attached cone) to move back and forth, thereby reproducing sound under the control of the applied electrical audio signal coming from the content processor 8. Although electromagnetic dynamic loudspeaker drivers are described, those skilled in the art will recognize that other types of loudspeaker drivers, such as planar electromagnetic and electrostatic drivers may be used for the transducers 5.

Although shown in FIG. 1A as a loudspeaker array with multiple identical or similar transducers 5, in other embodiments the loudspeaker 3 may be a traditional speaker unit with a single transducer 5. For example, the loudspeaker 3 may include a single tweeter, a single mid-range driver, or a single full-range driver. As shown in FIG. 1B, the loudspeakers 3A and 3B, each include a single transducer 5.

In one embodiment, the loudspeaker 3 includes a buffer 9 for storing a reference copy of segments of audio signals received by the audio input 7. For example, the buffer 9 may continually store two second segments of the audio signal received from the content processor 8. The buffer 9 may be any storage medium capable of storing data. For example, the buffer 9 may be microelectronic, non-volatile random access memory.

Figure 3A:
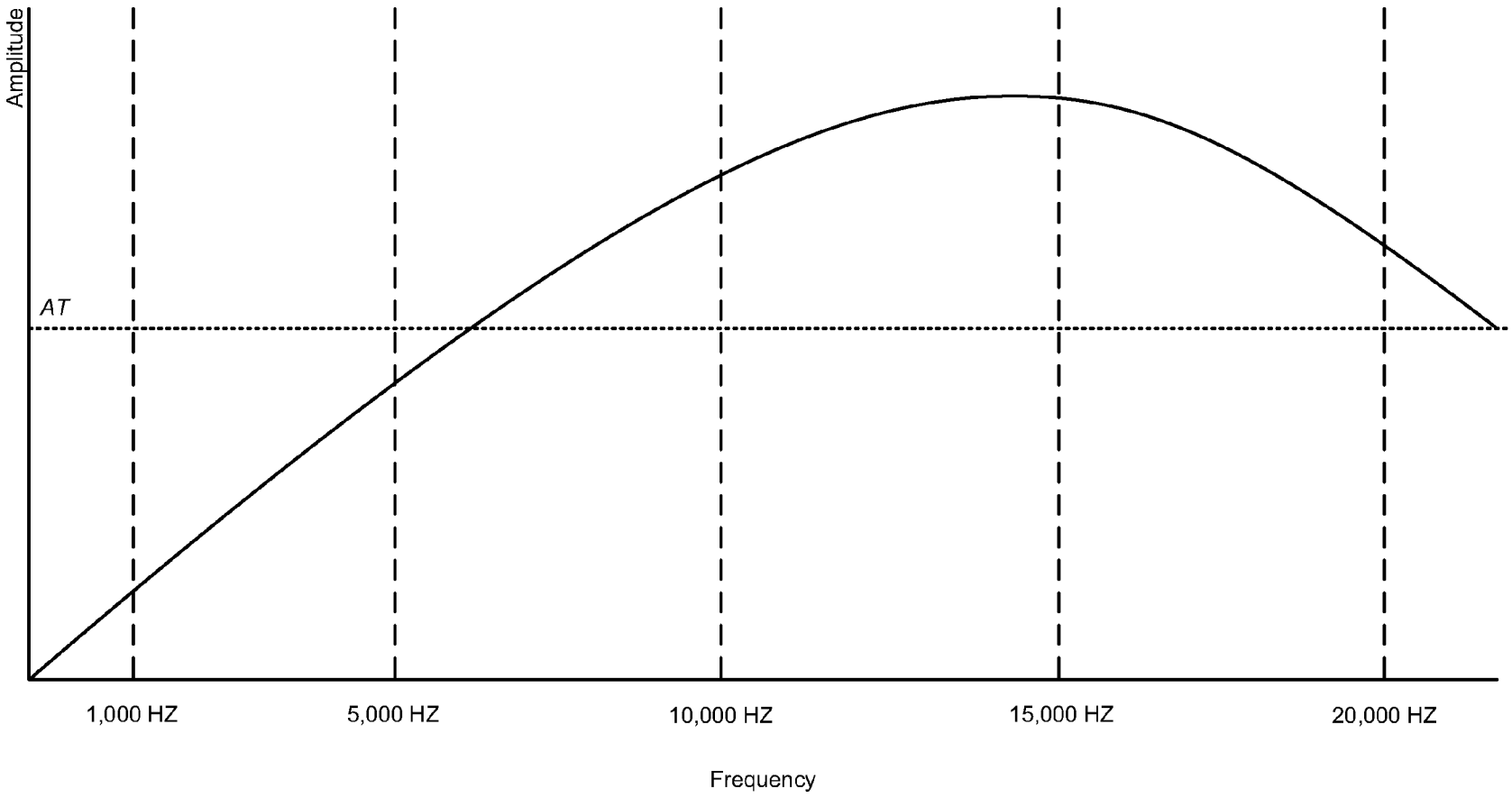
FIGS. 3A and 3B show sample signal segments.
Figure 3B:
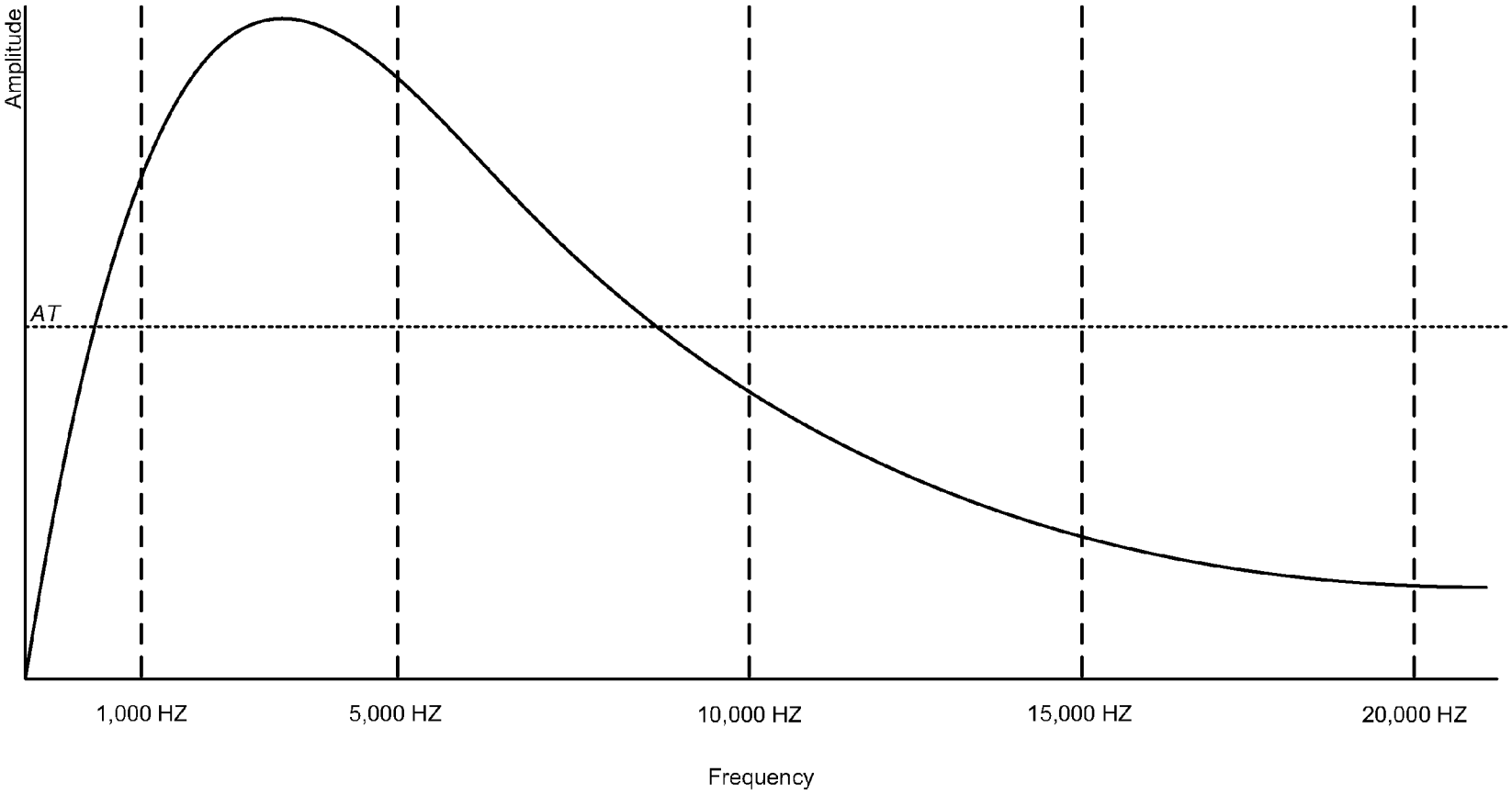

In one embodiment, the loudspeaker 3 includes a spectrum analyzer 10 for characterizing a segment of an input audio signal. For example, the spectrum analyzer 10 may analyze signal segments stored in the buffer 9. The spectrum analyzer 10 may characterize each analyzed signal segment in terms of one or more frequency bands. For example, the spectrum analyzer 10 may characterize the sample signal segment shown in FIG. 3A in terms of five frequency bands: 0 Hz-1,000 Hz; 1,001 Hz-5,000 Hz; 5,001 Hz-10,000 Hz; 10,001 Hz-15,000 Hz; and 15,001 Hz-20,000 Hz. The sample signal segment of FIG. 3A may be compared against an amplitude threshold AT for these five frequency bands to determine which bands meet the threshold AT. For the sample signal segment shown in FIG. 3A, the 5,001 Hz-10,000 Hz; 10,001 Hz-15,000 Hz; and 15,001 Hz-20,000 Hz bands meet the threshold AT while the 0 Hz-1,000 Hz and 1,001 Hz-5,000 Hz bands do not meet the threshold AT. FIG. 3B shows another sample signal segment. In this sample signal segment, the 0 Hz-1,000 Hz; 1,001 Hz-5,000 Hz; and 5,001 Hz-10,000 Hz bands meet the threshold AT while the 10,001 Hz-15,000 Hz and 15,001 Hz-20,000 Hz bands do not meet the threshold AT. This spectrum characterization/analysis for each signal segment may be represented in a table or other data structure. For example the spectrum characterization table for the signal in FIG. 3A may be represented as:

| Freq. Band | Meet AT? |
|---|---|
| 0 Hz-1,000 Hz | No |
| 1001 Hz-5,000 Hz | No |
| 5,001 Hz-10,000 Hz | Yes |
| 10,001 Hz-15,000 Hz | Yes |
| 15,001 Hz-20,000 Hz | Yes |

An example spectrum characterization table for the signal in FIG. 3B may be represented as:

| Freq. Band | Meet AT? |
|---|---|
| 0 Hz-1,000 Hz | Yes |
| 1001 Hz-5,000 Hz | Yes |
| 5,001 Hz-10,000 Hz | Yes |
| 10,001 Hz-15,000 Hz | No |
| 15,001 Hz-20,000 Hz | No |

These spectrum characterization tables may be stored in local memory in the loudspeaker 3. For example, the spectrum characterization tables or other data representing the spectrum of the signal segment (including the signal segment itself) may be stored in memory unit 15 as will be described in further detail below.

In one embodiment, the loudspeaker 3 includes a cross-correlation unit 11 for comparing a signal segment stored in the buffer 9 against a sensed audio signal received from the handheld listening device 4. The cross-correlation unit 11 may measure the similarity of the signal segment and the sensed audio signal to determine a time separation between similar audio characteristics amongst the two signals. For example, the cross-correlation unit 11 may determine that there is a five millisecond delay time between the signal segment stored in the buffer 9 and the sensed audio signal received from the handheld listening device 4. This time delay reflects the elapsed time between the signal segment being emitted as sound through the transducers 5, the emitted sounds being sensed by the listening device 4 to generate a sensed audio signal, and the sensed audio signal being transmitted to the loudspeaker 3.

In one embodiment, the loudspeaker 3 includes a delay unit 12 for delaying the signal segment stored in the buffer 9 based on a delay time generated by the cross-correlation unit 11. In the example provided above, the delay unit 12 may delay the signal segment by five milliseconds in response to the cross-correlation unit 11 determining that there is a five millisecond delay time between the input signal segment and the sensed audio signal received from the listening device 4. Applying a delay ensures the signal segment stored in the buffer 9 is accurately processed by a least mean square filter 13 and error unit 14 along with a corresponding portion of the sensed audio signal. The delay unit 12 may be any device capable of delaying an audio signal, including a digital signal processor and/or a set of analog or digital filters.

As described above, the delayed signal segment is processed by the least mean square filter 13 and the error unit 14. The least mean square filter 13 employs an adaptive filtering technique that adjusts coefficient estimates for the impulse response of the listening area 1 such that the least mean square of an error signal/value received from the error unit 14 is minimized. Although described as a least mean square filter, in other embodiments the least mean square filter 13 may be replaced by any adaptive filter or any stochastic gradient descent based filter that adjusts coefficient results based on an error signal. In one embodiment, the least mean square filter 13 estimates a set of coefficients H representing the impulse response for the listening area 1 based on an error signal received from the error unit 14. During an initial run, the least mean square filter 13 may generate an estimated set of coefficients H without an error signal or an error signal with a default value, since an error signal has not yet been generated.

The least mean square filter 13 applies the derived coefficients H to the delayed input signal segment to produce a filtered signal. The error unit 14 subtracts the filtered signal from the sensed audio signal received from the handheld listening device 4 to produce an error signal/value. If the set of coefficients H match the impulse response of the listening area 1, the filtered signal would exactly cancel the sensed audio signal such that the error signal/value would be equal to zero. Otherwise, if the set of coefficients H do not exactly match the impulse response of the listening area 1, the subtraction of the filtered signal from the sensed audio signal would yield a non-zero error signal/value (i.e., error value>0 or error value<0).

The error unit 14 feeds the error signal/value to the least mean square filter 13. The least mean square filter 13 adjusts the set of coefficients H, which represent an estimation of the impulse response of the listening area 1, based on the error signal/value. The adjustment may be performed to minimize the error signal using a cost function. In one embodiment, if the error signal is below a predefined error level, indicating that the coefficients accurately represent the impulse response of the listening area 1, the least mean square filter 13 stores the set of coefficients H in the memory unit 15 without generating an updated set of coefficients H. The set of coefficients H may be stored in the memory unit 15 along with the spectrum characterizations generated by the spectrum analyzer 10 for the corresponding signal segment. The memory unit 15 may be any storage medium capable of storing data. For example, the memory unit 15 may be microelectronic, non-volatile random access memory.

In one embodiment, the loudspeaker 3 may include a coefficient analyzer 16 for examining generated/stored coefficients Hand corresponding spectrum characterizations. In one embodiment, the coefficient analyzer 16 analyzes each set of stored coefficients H in the memory unit 15 to determine the possible existence of one or more abnormal coefficients H. For example, a set of coefficients H may be considered abnormal if they significantly deviate from one or more other sets of generated/stored coefficients H and/or a set of predefined coefficients H. The predefined set of coefficients H may be preset by a manufacturer of the loudspeaker 3 and correspond to the impulse responses of an average listening area 1.

Since each of the stored sets of coefficients H represents the impulse response of the listening area 1, their variance should be small (i.e., standard deviation should be low). However, although each set of coefficients H are generated for the same listening area 1, small differences may be present resulting from the use of different signal segments to generate each set of coefficients H and minor changes to the listening area 1 (e.g., more/less people in the listening area 1 and movement of objects/furniture). In one embodiment, sets of coefficients H that deviate from one or more other sets of coefficients H by more than a predefined tolerance level (e.g., a predefined deviation) are considered abnormal. Each set of abnormal coefficients Hand corresponding spectrum characteristics may be removed from the memory unit 15 or flagged as abnormal by the coefficient analyzer 16 such that these coefficients Hand corresponding spectrum characteristics are not used to modify subsequent audio signal segments by the content processor 8.

In one embodiment, the coefficient analyzer 16 also determines if the stored sets of coefficients H represent a sufficient audio spectrum to allow for processing of subsequent signals to compensate for the impulse response of the listening area 1. In one embodiment, each spectrum characterization generated by spectrum analyzer 10 corresponding to each of the stored sets of coefficients H is analyzed to determine if a sufficient amount of the audio spectrum is represented. For example, the audio spectrum may be analyzed with respect to five frequency bands: 0 Hz-1,000 Hz; 1,001 Hz-5,000 Hz; 5,001 Hz-10,000 Hz; 10,001 Hz-15,000 Hz; and 15,001 Hz-20,000 Hz. If a spectrum characterization of a single signal segment meets or exceeds the amplitude threshold AT for each of these five frequency bands, the corresponding sets of coefficients H for this signal segment sufficiently covers the audio spectrum. In this case, the single set of coefficients H may be fed to the content processor 8 to modify subsequent signal segments received through the input 7.

In other cases, where a single signal segment and set of coefficients H do not sufficiently cover the desired audio spectrum, multiple sets of coefficients H corresponding to multiple signal segments may be used. These two or more sets of coefficients H may be used to collectively represent a defined spectrum. For the sample signal segment shown in FIG. 3A, the 5,001 Hz-10,000 Hz; 10,001 Hz-15,000 Hz; and 15,001 Hz-20,000 Hz bands meet the threshold AT while the 20 Hz-1,000 Hz and 1,001 Hz-5,000 Hz bands do not meet the threshold AT. Accordingly, the signal in FIG. 3A does not alone sufficiently cover the audio spectrum. Similarly, for the sample signal segment shown in FIG. 3B, the 0 Hz-1,000 Hz; 1,001 Hz-5,000 Hz; and 5,001 Hz-10,000 Hz bands meet the threshold AT while the 10,001 Hz-15,000 Hz and 15,001 Hz-20,000 Hz bands do not meet the threshold AT. Although neither of the signals in FIG. 3A or 3B individually represents the entire spectrum, collectively these signals cover the spectrum (i.e., between the two signals each of the five example bands meet or exceed the threshold AT). In this example, since two signal segments collectively represent the defined spectrum, the coefficient analyzer 16 may combine/mix corresponding sets of coefficients H for these signals. The combined sets of coefficients H for these sample signals may thereafter be used by the content processor 8 to modify subsequent signal segments received through the input 7. For example, the combined sets of coefficients H may be fed to the content processor 8 to modify subsequent input signal segments received by the input 7. In one embodiment, the inverse of the sets of coefficients H may be applied to signal segments processed by the content processor 8 to compensate for distortions caused by the impulse response of the listening area 1.

In one embodiment, the loudspeaker 3 may also include a wireless controller 17 that receives and transmits data packets from a nearby wireless router, access point, and/or other device. The controller 17 may facilitate communications between the loudspeaker 3 and the listening device 4 and/or the loudspeaker 3 and the audio receiver 2 through a direct connection or through an intermediate component (e.g., a router or a hub). In one embodiment, the wireless controller 17 is a wireless local area network (WLAN) controller while in other embodiments the wireless controller 17 is a Bluetooth controller.

Although described in relation to a dedicated speaker, the loudspeaker 3 may be any device that houses transducers 5. For example, the loudspeaker 3 may be defined by a laptop computer, a mobile audio device, or a tablet computer with integrated transducers 5 for emitting sound.

As noted above, the loudspeaker 3 emits sound into the listening area 1 to represent one or more channels of a piece of sound program content. The listening area 1 is a location in which the loudspeaker 3 is located and in which the listener 6 is positioned to listen to sound emitted by the loudspeaker 3. For example, the listening area 1 may be a room within a house, commercial, or manufacturing establishment or an outdoor area (e.g., an amphitheater). The listener 6 may be holding the listening device 4 such that the listening device 4 is able to sense similar or identical sounds, including level, pitch, and timbre, perceivable by the listener 6.

Figure 4:
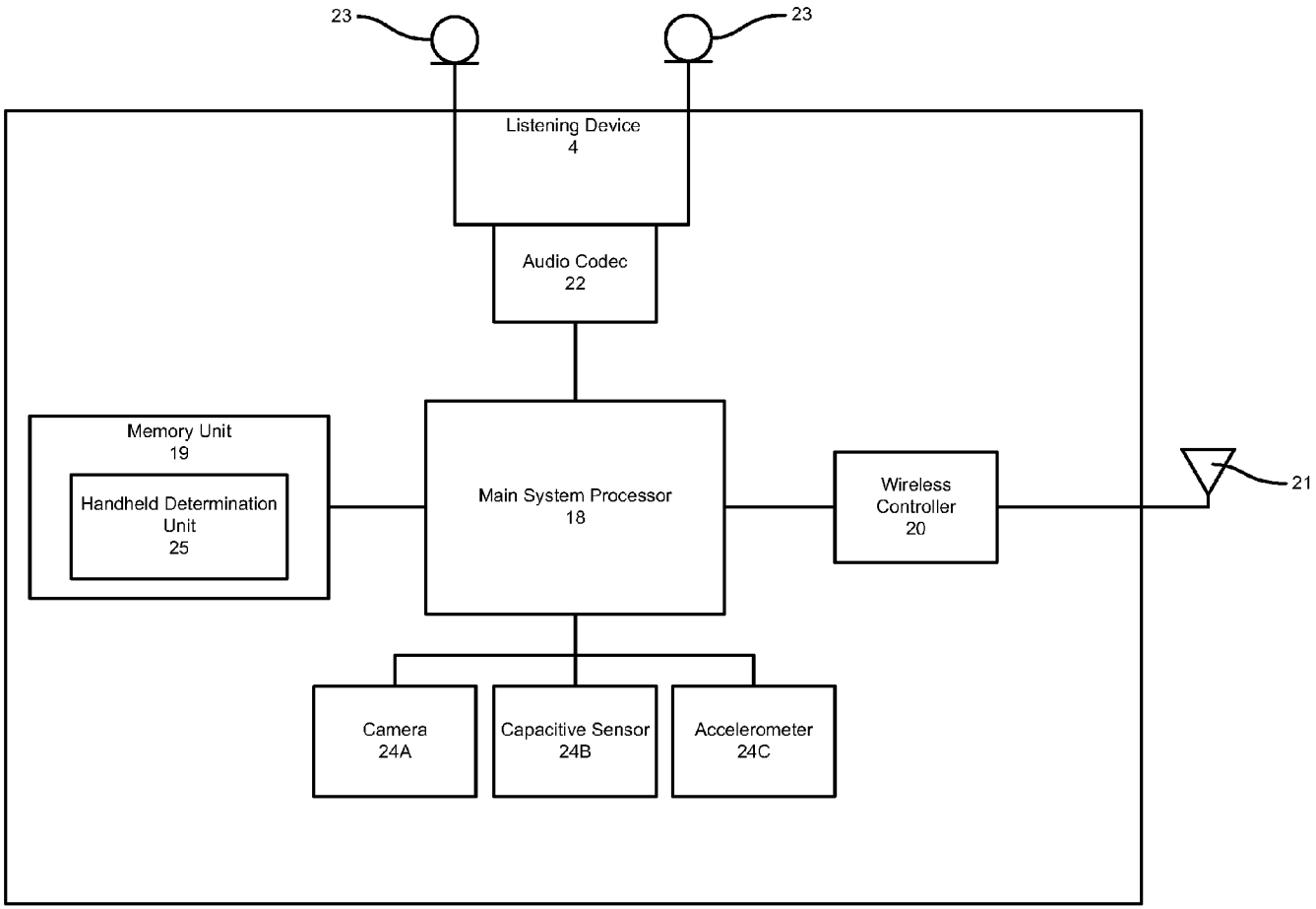
FIG. 4 shows a functional unit block diagram and some constituent hardware components of the handheld listening device according to one embodiment.

FIG. 4 shows a functional unit block diagram and some constituent hardware components of the handheld listening device 4 according to one embodiment. The components shown in FIG. 4 are representative of elements included in the listening device 4 and should not be construed as precluding other components. Each element of the listening device 4 will be described by way of example below.

The listening device 4 may include a main system processor 18 and a memory unit 19. The processor 18 and the memory unit 19 are generically used here to refer to any suitable combination of programmable data processing components and data storage that conduct the operations needed to implement the various functions and operations of the listening device 4. The processor 18 may be an applications processor typically found in a smart phone, while the memory unit 19 may refer to microelectronic, non-volatile random access memory. An operating system may be stored in the memory unit 19 along with application programs specific to the various functions of the listening device 4, which are to be run or executed by the processor 18 to perform the various functions of the listening device 4.

In one embodiment, the listening device 4 may also include a wireless controller 20 that receives and transmits data packets from a nearby wireless router, access point, and/or other device using an antenna 21. The wireless controller 20 may facilitate communications between the loudspeaker 3 and the listening device 4 through a direct connection or through an intermediate component (e.g., a router or a hub). In one embodiment, the wireless controller 20 is a wireless local area network (WLAN) controller while in other embodiments the wireless controller 20 is a Bluetooth controller.

In one embodiment, the listening device 4 may include an audio codec 22 for managing digital and analog audio signals. For example, the audio codec 22 may manage input audio signals received from one or more microphones 23 coupled to the codec 22. Management of audio signals received from the microphones 23 may include analog-to-digital conversion and general signal processing. The microphones 23 may be any type of acoustic-to-electric transducer or sensor, including a MicroElectrical-Mechanical System (MEMS) microphone, a piezoelectric microphone, an electret condenser microphone, or a dynamic microphone. The microphones 23 may provide a range of polar patterns, such as cardioid, omnidirectional, and figure-eight. In one embodiment, the polar patterns of the microphones 23 may vary continuously over time. In one embodiment, the microphones 23 are integrated in the listening device 4. In another embodiment, the microphones 23 are separate from the listening device 4 and are coupled to the listening device 4 through a wired or wireless connection (e.g., Bluetooth and IEEE 802.11x).

In one embodiment, the listening device 4 may include one or more sensors 24 for determining the orientation of the device 4 in relation to the listener 6. For example, the listening device 4 may include one or more of a camera 24A, a capacitive sensor 24B, and an accelerometer 24C. Outputs of these sensors 24 may be used by a handheld determination unit 25 for determining whether the listening device 4 is being held in the hand of the listener 6 and/or near an ear of the listener 6. Determining when the listening device 4 is located near the ear of the listener 6 assists in determining when the listening device 4 is in a good position to accurately sense sounds heard by the listener 6. These sensed sounds may thereafter be used to determine the impulse response of the listening area 1 at the location of the listener 6.

For example, the camera 24A may capture and detect the face of the listener 6. The detected face of the listener 6 indicates that the listening device 4 is likely being held near an ear of the listener 6. In another example, the capacitive sensor 24B may sense the capacitive resistance of flesh on multiple points of the listening device 4. The detection of flesh on multiple points of the listening device 4 indicates that the listening device 4 is being held in the hand of the listener 6 and likely near an ear of the listener 6. In still another example, the accelerometer 24C may detect the involuntary hand movements/shaking of the listener 6. This distinct detected vibration frequency indicates that the listening device 4 is being held in the hand of the listener 6 and likely near an ear of the listener 6.

Based on one or more of the above described sensor inputs, the handheld determination unit 25 determines whether the listening device 4 is being held in the hand and/or near the ear of a listener 6. This determination may be used to instigate the process of determining the impulse response of the listening area 1 by (1) recording sound in the listening area 1 using the one or more microphones 23 and (2) transmitting these recorded/sensed sounds to the loudspeaker 3 for processing.

Figure 5:
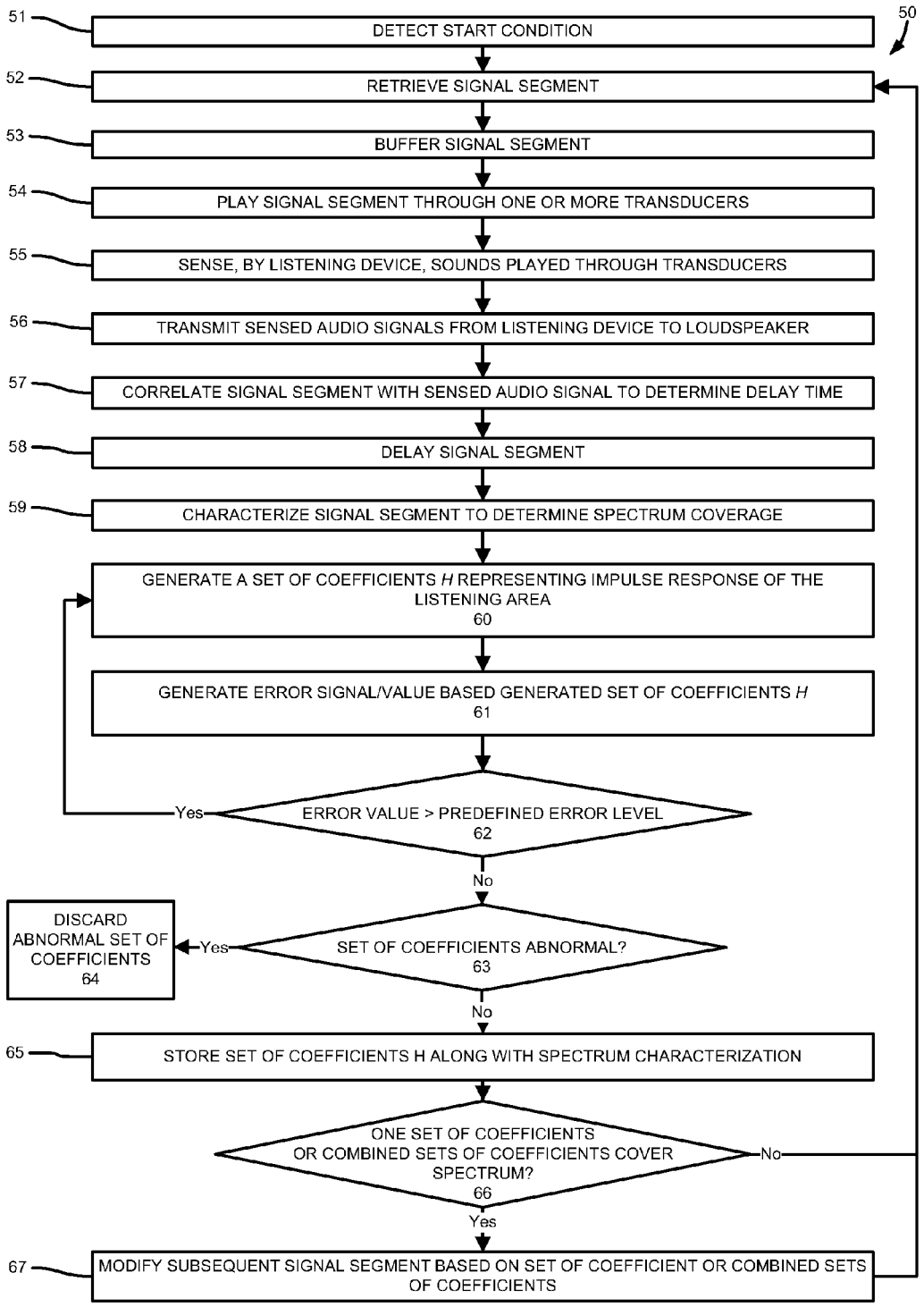
FIG. 5 shows a method for determining the impulse response of the listening area according to one embodiment.

FIG. 5 shows a method 50 for determining the impulse response of the listening area 1 according to one embodiment. The method 50 may be performed by one or more components of both the loudspeaker 3 and the listening device 4.

The method 50 begins at operation 51 with the detection of a start condition. The start condition may be detected by the loudspeaker 3 or the listening device 4. In one embodiment, a start condition may be the selection by the listener 6 of a configuration or reset button on the loudspeaker 3 or the listening device 4. In another embodiment, the start condition is the detection by the listening device 4 that the listening device 4 is near/proximate to an ear of the listener 6. This detection may be performed automatically by the listening device 4 through the use of one or more integrated sensors 24 and without direct input by the listener 6. For example, outputs from one or more of a camera 24A, a capacitive sensor 24B, and an accelerometer 24C may be used by the handheld determination unit 25 within the listening device 4 to determine that the listening device 4 is near/proximate to an ear of the listener 6 as described above. Determining when the listening device 4 is located near the ear of a listener 6 assists in determining when the listening device 4 is in a good position to accurately sense sounds heard by the listener 6 such that an accurate impulse response for the listening area 1 relative to the listener 6 may be determined.

Upon detection of a start condition, operation 52 retrieves a signal segment. The signal segment is a division of an audio signal from either an external audio source (e.g., the audio receiver 2) or a local memory source within the loudspeaker 3. For example, the signal segment may be a two second time division of an audio signal received from the audio receiver 2 through the input 7 of the loudspeaker 3.

The signal segment is buffered at operation 53 while a copy of the signal segment is played through one or more transducers 5 at operation 54. In one embodiment, the signal segment is buffered by the buffer 9 of the loudspeaker 3. Buffering the signal segment allows the signal segment to be processed after the copied signal segment is played through the transducers 5 as will be described in further detail below.

At operation 55, the sounds played through the transducers 5 at operation 54, based on the signal segment, are sensed by the listening device 4. The listening device 4 may sense the sounds using one or more of the microphones 23 integrated or otherwise coupled to the listening device 4. As noted above, the listening device 4 is positioned proximate to an ear of the listener 6. Accordingly, the sensed audio signal generated at operation 54 characterizes the sounds heard by the listener 6.

At operation 56, the sensed audio signal generated at operation 55 may be transmitted to the loudspeaker 3 through a wireless medium/interface. For example, the listening device 4 may transmit the sensed audio signal to the loudspeaker 3 using the wireless controller 20. The loudspeaker 3 may receive this sensed audio signal through the wireless controller 17.

At operation 57, the sensed audio signal and the signal segment buffered at operation 53 are cross-correlated to determine the delay time between the two signals. The cross-correlation may measure the similarity of the signal segment and the sensed audio signal and determine a time separation between similar audio characteristics amongst the two signals. For example, the cross-correlation may determine that there is a five millisecond delay time between the signal segment and the sensed audio signal. This time delay reflects the elapsed time between the signal segment being emitted as sound through the transducers 5 at operation 54, the emitted sounds being sensed by the listening device 4 to generate a sensed audio signal at operation 55, and the sensed audio signal being transmitted to the loudspeaker 3 at operation 56.

At operation 58, the signal segment is delayed by the delay time determined at operation 57. Applying a delay ensures the signal segment is processed along with a corresponding portion of the sensed audio signal. The delay may be performed by any device capable of delaying an audio signal, including a digital signal processor and a set of analog or digital filters.

At operation 59, the signal segment is characterized to determine the frequency spectrum covered by the signal. This characterization may include determining which frequencies are audible in the signal segment or which frequency bands raise above a predefined amplitude threshold AT. For example, a set of separate frequency bands in the signal segment may be analyzed to determine which bands meet or exceed the amplitude threshold AT. Tables 1 and 2 above show example spectrum characterizations for the sample signals in FIGS. 3A and 3B, respectively, which may be generated at operation 59.

At operation 60, a set of coefficients H is generated that represent the impulse response of the listening area 1 based on the delayed signal segment. The set of coefficients H may be generated by the least mean square filter 13 or another adaptive filter within the loudspeaker 3. Following the generation of a set of coefficients H that represent the impulse response of the listening area 1, operation 61 determines an error signal/value for the set of coefficients. In one embodiment, the error unit 14 may determine the error signal/value. In one embodiment, the error signal is generated by applying the set of coefficients H to the delayed signal segment. Operation 61 subtracts the filtered signal from the sensed audio signal to produce an error signal/value. If the set of coefficients H match the impulse response of the listening area 1, the filtered signal would exactly cancel the sensed audio signal such that the error signal/ value would be equal to zero. Otherwise, if the set of coefficients H do not exactly match the impulse response of the listening area 1, the subtraction of the filtered signal from the sensed audio signal would yield a non-zero error signal/value (i.e., error value>0 or error value<0).

At operation 62, the error signal is compared against a predefined error value. If the error signal is above the predefined error value, the method 50 returns to operation 60 to generate a new set of coefficients H based on the error signal. A new set of coefficients H is continually computed until a corresponding error signal is below the predefined error value. This repeated computation in response to a high error value ensures that the set of coefficients H accurately represent the impulse response of the listening area 1.

Upon determining that a set of coefficients H are below the predefined error level at operation 62, the method 50 moves to operation 63. At operation 63, the set of coefficients H generated through one or more performances of operations 60, 61, and 62 are analyzed to determine their deviation from other previously generated sets of coefficients H corresponding to other signal segments or predefined coefficients H of typical listening areas 1. Determining deviation of the set of coefficients H ensures that the newly generated sets of coefficients H are not abnormal. Since each generated set of coefficients H represents the impulse response of the listening area 1, their variance should be small (i.e., standard deviation should be low). However, although each set of coefficients H are generated for the same listening area 1, small differences may be present resulting from the use of different signal segments to generate each set of coefficients H and minor changes to the listening area 1 (e.g., more/less people in the listening area 1 and movement of objects/furniture). In one embodiment, sets of coefficients H that deviate from one or more other sets of coefficients H by more than a predefined tolerance level (e.g., a predefined standard deviation) are considered abnormal. Each set of abnormal coefficients H and corresponding spectrum characteristics may be discarded at operation 64 such that these coefficients H and corresponding spectrum characteristics are not used to modify subsequent signal segments processed by the content processor 8.

If operation 63 determines that the newly generated set of coefficients H is normal, operation 65 may store the set of coefficients H along with the corresponding spectrum characteristics. In one embodiment, the set of coefficients H may be stored in the memory unit 15 along with the spectrum characterizations generated at operation 59 for the corresponding signal segment.

At operation 66, the method 50 analyzes each of the stored sets of coefficients H and corresponding spectrum characteristics to determine if the stored sets of coefficients H represent a sufficient audio spectrum to allow for processing of future/subsequent signal segments received through the input 7 to compensate for the impulse response of the listening area 1 at operation 67. In one embodiment, each spectrum characterization generated at operation 59 corresponding to each of the stored sets of coefficients H is analyzed to determine if a sufficient amount of the audio spectrum is represented by these coefficients H. For example, the audio spectrum may be analyzed with respect to five frequency bands: 0 Hz-1,000 Hz; 1,001 Hz-5,000 Hz; 5,001 Hz-10,000 Hz; 10,001 Hz-15,000 Hz; and 15,001 Hz-20,000 Hz. If a spectrum characterization of a single signal segment meets or exceeds the amplitude threshold AT for each of these five frequency bands, the corresponding sets of coefficients H for this signal segment sufficiently covers the audio spectrum. In this case, the single set of coefficients H may be fed to the content processor 8 to modify subsequent signal segments received through the input 7 at operation 67.

In other cases, where a single signal segment and set of coefficients H do not sufficiently cover the desired audio spectrum, multiple sets of coefficients H corresponding to multiple signal segments may be used. These two or more sets of coefficients H may be used to collectively represent a defined spectrum. For the sample signal segment shown in FIG. 3A, the 5,001 Hz-10,000 Hz; 10,001 Hz-15,000 Hz; and 15,001 Hz-20,000 Hz bands meet the threshold AT while the 20 Hz-1,000 Hz and 1,001 Hz-5,000 Hz bands do not meet the threshold AT. Accordingly, the signal in FIG. 3A does not alone sufficiently cover the audio spectrum. Similarly, for the sample signal segment shown in FIG. 3B, the 0 Hz-1,000 Hz; 1,001 Hz-5,000 Hz; and 5,001 Hz-10,000 Hz bands meet the threshold AT while the 10,001 Hz-15,000 Hz and 15,001 Hz-20,000 Hz bands do not meet the threshold AT. Although neither of the signals in FIG. 3A or 3B individually represents the entire spectrum, collectively these signals cover the spectrum (i.e., between the two signals each of the five example bands meet or exceed the threshold AT). In this example, since two signal segments collectively represent the defined spectrum, the coefficient analyzer 16 may combine/mix corresponding sets of coefficients H for these signals. The combined sets of coefficients H for these sample signals may thereafter be used by the content processor 8 to modify subsequent signal segments received through the input 7. For example, the combined sets of coefficients H may be fed to the content processor 8 to modify subsequent input signal segments received by the input 7. In one embodiment, the inverse of the sets of coefficients H may be applied to signal segments processed by the content processor 8 to compensate for distortions caused by the impulse response of the listening area 1 at operation 67.

In response to determining that one or more sets of coefficients H do not sufficiently cover the desired audio spectrum, the method 50 moves back to operation 52 to retrieve another signal segment. The method 50 continues to analyze signal segments and generate sets of coefficients H until operation 66 determines that one or more sets of coefficients H sufficiently cover the desired audio spectrum.

In response to determining that one or more sets of coefficients H sufficiently cover the desired audio spectrum, operation 67 modifies subsequent signal segments received through input 7 based on these sets of coefficients H. In one embodiment, the inverse of the one or more sets of coefficients H are applied to signal segments at operation 67 (i.e., $H^{-1}$). These processed subsequent signal segments may thereafter be played through the transducers 5.

The systems and methods described above determine the impulse response of the listening area 1 in a robust manner while the loudspeaker 3 is performing normal operations (e.g., outputting sound corresponding to a musical composition or an audio track of a movie). Accordingly, the impulse response of the listening area 1 may be continually determined, updated, and compensated for without the use of complex measurement techniques that rely on known audio signals and static environments.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for adjusting sound emitted by a loudspeaker in a room, comprising:

driving one or more transducers to emit sounds based on a first segment of an audio signal;

characterizing spectral characteristics of the first segment;

receiving, by the loudspeaker, a sensed audio signal from a handheld device, wherein the sensed audio signal represents the sounds emitted by the one or more transducers corresponding to the first segment of the audio signal;

estimating, by an adaptive filter, an impulse response for the room based on the first segment of the audio signal;

determining an error value for the estimated impulse response based on the sensed audio signal;

storing the impulse response and the spectral characteristics of the first segment, in response to the error value being below a predefined error level and the impulse response being within a tolerance level of one or more previously stored impulse responses; and processing a second segment of the audio signal based on a given one or more previously stored impulse responses, in response to determining that previously stored spectral characteristics, corresponding to the given one or more previously stored impulse responses, cover a predefined spectrum.

2. The method of claim 1, further comprising:

correlating the first segment with the sensed audio signal to determine a delay time between the first segment and the sensed audio signal; and delaying the first segment by the delay time to generate a delayed first segment, wherein the estimating the impulse response is performed with the delayed first segment.

3. The method of claim 1, further comprising:

determining that the handheld device is being held near an ear of a listener;

sensing, by the handheld device in response to determining the handheld device is being held near the ear of the listener, the sounds emitted by the one or more transducers; and transmitting, by the handheld device, the sensed audio signal to the loudspeaker.

4. The method of claim 3, wherein sensing that the handheld device is being held near the ear of the listener is performed based on inputs from one or more of a capacitive sensor, an accelerometer, and a camera.

5. The method of claim 1, further comprising:

combining two or more previously stored impulse responses whose associated spectral characteristics collectively cover the predefined spectrum, wherein processing the second segment is performed based on the combined two or more previously stored impulse responses.

6. The method of claim 1, further comprising:

estimating, in response to the error value being equal or above the predefined error level, a new impulse response for the room based on the first segment and the error value;

determining a new error value for the new impulse response; and storing the new impulse response and the spectral characteristics of the first segment, in response to the new error value of the new impulse response being below the predefined error level and the new impulse response being within the tolerance level of one or more previously stored impulse responses.

7. The method of claim 1, wherein the tolerance level is a measured deviation between the impulse response and the one or more previously stored impulse responses.

8. The method of claim 1, wherein the first segment and the second segment are time divisions of the audio signal.

9. The method of claim 1, wherein the audio signal represents a channel of a piece of multichannel audio content.

10. A loudspeaker, comprising:

a transducer for emitting sounds corresponding to a first segment of an audio signal;

a wireless controller for receiving a sensed audio signal from a listening device, wherein the sensed audio signal represents the sounds emitted by the transducer corresponding to the first segment of the audio signal an adaptive filter for estimating an impulse response of a room in which the loudspeaker is located based on the first segment of the audio signal;

an error unit for determining an error value for the estimated impulse response of the room based on the sensed audio signal, wherein the controller stores the impulse response and spectral characteristics of the first segment in response to (i) the error value being below a predefined error level and (ii) the impulse response being within a tolerance level of one or more previously stored impulse responses; and a content processor for processing a second segment of the audio signal based on a given one or more previously stored impulse responses, in response to determining that previously stored spectral characteristics, corresponding to the given one or more previously stored impulse responses, cover a predefined spectrum.

11. The loudspeaker of claim 10, further comprising:

a spectrum analyzer for characterizing the first segment and generating the spectral characteristics of the first segment.

12. The loudspeaker of claim 10, further comprising:

a cross-correlation unit for correlating the first segment with the sensed audio signal to determine a delay time between the first segment and the sensed audio signal; and a delay unit for delaying the first segment by the delay time to generate a delayed first segment, wherein the adaptive filter estimates the impulse response of the room using the delayed first segment.

13. The loudspeaker of claim 10, further comprising:

a coefficient analyzer for combining two or more previously stored impulse responses whose associated spectral characteristics collectively cover the predefined spectrum, wherein the content processor processes the second segment based on the combined two or more previously stored impulse responses.

14. The loudspeaker of claim 10, wherein the adaptive filter estimates a new impulse response for the room based on the first segment and the error value, in response to the error value being equal or above the predefined error level.

15. The loudspeaker of claim 10, wherein the tolerance level is a measured deviation between the impulse response and the one or more previously stored impulse responses.

16. The loudspeaker of claim 10, wherein the adaptive filter is a linear mean square filter.

17. An article of manufacture for adjusting sound emitted by a loudspeaker in a room, comprising:

a machine-readable storage medium that stores instructions which, when executed by a processor in a computer, characterize spectral characteristics of a first segment of an audio signal;

receive a sensed audio signal from a handheld device, wherein the sensed audio signal represents sounds emitted by one or more transducers corresponding to the first segment of the audio signal;

estimate, by an adaptive filter, an impulse response for the room based on the first segment of the audio signal;

determine an error value for the estimated impulse response based on the sensed audio signal;

store the impulse response and the spectral characteristics of the first segment in response to the error value being below a predefined error level and the impulse response being within a tolerance level of one or more previously stored impulse responses; and process a second segment of the audio signal based on a given one or more previously stored impulse responses, in response to determining that previously stored spectral characteristics, corresponding to the given one or more previously stored impulse responses, cover a predefined spectrum.

18. The article of manufacture of claim 17, wherein the machine-readable storage medium stores additional instructions which, when executed by the processor in the computer, correlate the first segment with the sensed audio signal to determine a delay time between the first segment and the sensed audio signal; and delay the first segment by the delay time to generate a delayed first segment, wherein the estimating the impulse response is performed with the delayed first segment.

19. The article of manufacture of claim 17, wherein the machine-readable storage medium stores additional instructions which, when executed by the processor in the computer, combine two or more previously stored impulse responses whose associated spectral characteristics collectively cover the predefined spectrum, wherein processing the second segment is performed based on the combined two or more previously stored impulse responses.

20. The article of manufacture of claim 17, wherein the machine-readable storage medium stores additional instructions which, when executed by the processor in the computer, estimate, in response to the error value being equal or above the predefined error level, a new impulse response for the room based on the first segment and the error value;

determine a new error value for the new impulse response; and store the new impulse response and the spectral characteristics of the first segment, in response to the new error value of the new impulse response being below the predefined error level and the new impulse response being within the tolerance level of one or more previously stored impulse responses.

21. The article of manufacture of claim 17, wherein the tolerance level is a measured deviation between the impulse response and the one or more previously stored impulse responses.

22. The article of manufacture of claim 17, wherein the first segment and the second segment are time divisions of the audio signal.

23. The article of manufacture of claim 17, wherein the audio signal represents a channel of a piece of multichannel audio content.

* * * * *